US005646637A

United States Patent [19]

Miller

[11] Patent Number: 5,646,637

[45] Date of Patent: Jul. 8, 1997

[54] SLOT ANTENNA WITH REDUCED GROUND PLANE

[75] Inventor: Alan Wayne Miller, Britton, Mich.

[73] Assignee: Ford Motor Company, Dearborn, Mich.

[21] Appl. No.: 711,402

[22] Filed: Sep. 5, 1996

Related U.S. Application Data

[63] Continuation of Ser. No. 375,073, Jan. 17, 1995, abandoned, which is a continuation of Ser. No. 118,856, Sep. 10, 1993, abandoned.

[51] Int. Cl.[6] ..... H01Q 1/32

[52] U.S. Cl. ..... 343/713; 343/711; 343/767; 343/770

[58] Field of Search ..... 343/713, 715, 343/711, 712, 767, 768, 770; H01Q 1/32

[56] References Cited

U.S. PATENT DOCUMENTS

| | | | |
|---|---|---|---|
| 2,755,465 | 7/1956 | Ramsay | 343/767 |
| 2,825,061 | 2/1958 | Rowland | 343/770 |
| 2,923,813 | 2/1960 | Davis | 343/767 |
| 4,973,958 | 11/1990 | Hirano et al. | 340/825.69 |
| 5,012,255 | 4/1991 | Becker | 343/704 |
| 5,220,336 | 6/1993 | Hirotsu et al. | 343/713 |
| 5,266,960 | 11/1993 | Lindenmeier et al. | 343/713 |
| 5,268,700 | 12/1993 | Hirotsu et al. | 343/713 |
| 5,285,210 | 2/1994 | Sato et al. | 343/713 |

FOREIGN PATENT DOCUMENTS

| | | | |
|---|---|---|---|
| 0332898 | 2/1989 | European Pat. Off. . | |
| 0382901 | 11/1989 | European Pat. Off. . | |
| 2-15702 | 1/1990 | Japan | H01Q 1/32 |
| 3-196704 | 8/1991 | Japan | H01Q 1/32 |
| 3-204201 | 9/1991 | Japan | H01Q 1/32 |
| 3-204202 | 9/1991 | Japan | H01Q 1/32 |
| 2210730 | 9/1988 | United Kingdom . | |

*Primary Examiner*—Hoanganh T. Le

*Attorney, Agent, or Firm*—Mark L. Mollon; Roger L. May

[57] ABSTRACT

A slot antenna has a substantially reduced ground plane by defining the slot within a loop of a narrow conductive strip, for example a deposited metal, around a slot opening less than one half the wavelength of the intended signal frequency to be received by the antenna. A conductor such as a central conductor of a coaxial cable coupled to the conductive strip on one side of the slot, while another conductor such as the ground shield of the coaxial cable is terminaled at a position across the slot from the central conductor terminal. In addition, the gain and bandwidth of the antenna may be improved by adding a similarly constructed loop or loops of slot antenna in parallel to the first slot to form an overlapping series of loops. Such a modification forms a ground plane with an overlapping series of loop conductors. As a result, the present invention permits a convenient, window mounted antenna assembly, as well as a particularly advantageous combination of window panel of a motor vehicle, as is particularly well adapted for use with remote keyless entry systems as well as cellular telephone systems.

17 Claims, 2 Drawing Sheets

Fig. 1
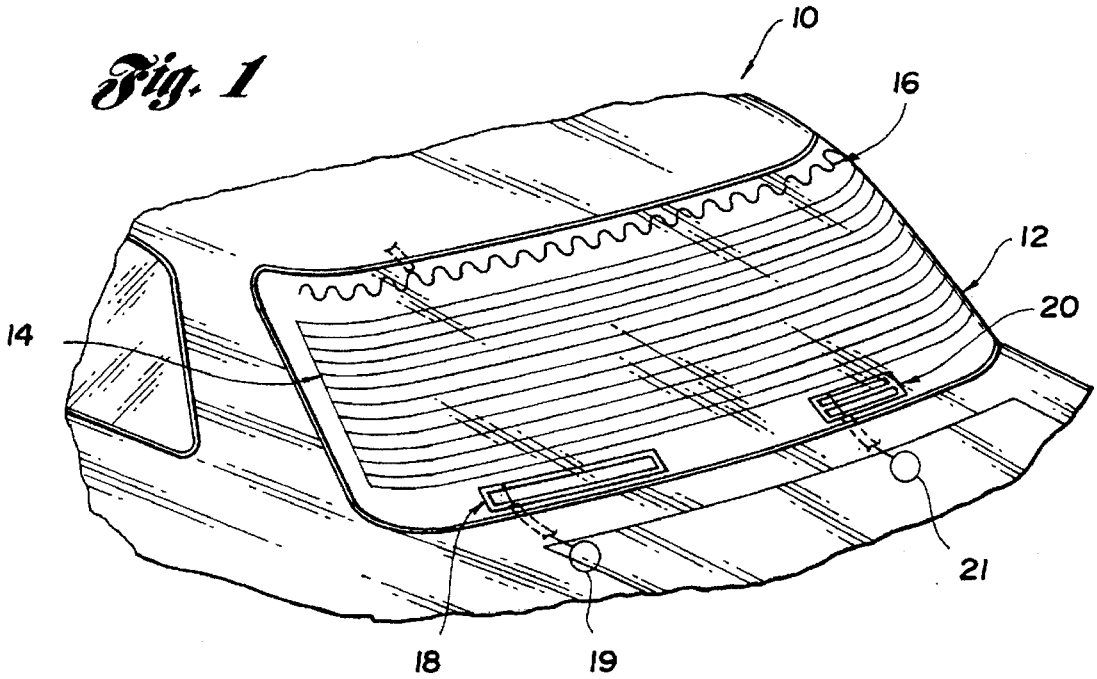
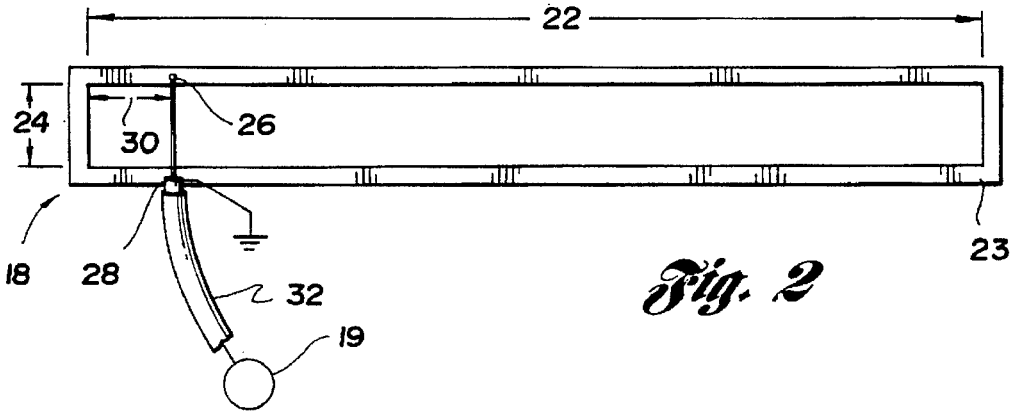
Fig. 2
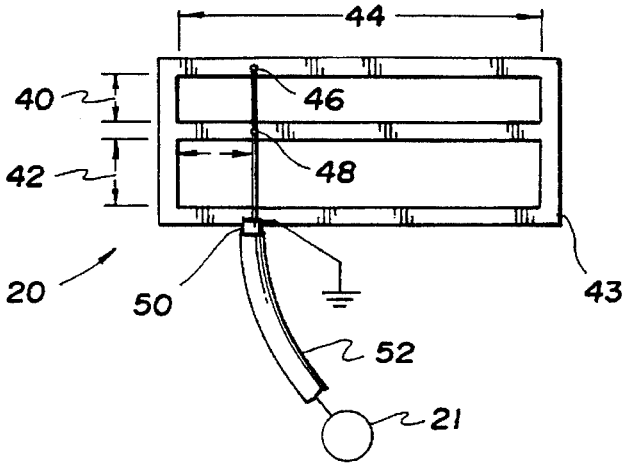
Fig. 3

SLOT ANTENNA WITH REDUCED GROUND PLANE

This is a continuation of application Ser. No. 08/375,073, filed on Jan. 17, 1995 now abandoned, which is a continuation of Ser. No. 08/118,856, filed on Sep. 10, 1993, now abandoned.

FIELD OF THE INVENTION

The present invention relates generally to antennas and, more particularly, to motor vehicle antenna constructions in the form of slot antennas.

BACKGROUND ART

A number of antennas has been developed to replace typical monopole antennas which are still widely used in motor vehicles because of their simple structure and effectiveness. However, because such antennas protrude from exterior surfaces of the vehicle, they are exposed to destructive impacts and create aerodynamic disturbances that affect performance or create noise as the vehicle travels. Moreover, retractor mechanisms for such antennas substantially increase the cost of supplying the component, and they displace the monopole from an operable, exposed position to an inoperative, retracted position where reception is obstructed by adjacent conductive parts such as engine parts, chassis parts or body panels.

One previous way to overcome such problems has been to incorporate the antenna in other body panels. For example, conductive body panels such as expanded areas of sheet metal may be employed to form slot antennas by cutting a slot into an expanded ground plane made of conductive material. Sheet metal panels of the vehicle have previously been employed to form the slot antenna. Conductor terminals are secured at locations on opposite sides of the slot to transfer the voltage signal received by the antenna. Adjusting the relative positions of the terminals on the ground plane affects the impedance of the antenna, but the ground plane is generally very large in relation to the size of the slots. Moreover, the surface area of ground plane would typically be enlarged in order to enhance the performance of the antenna. A shield of a coaxial cable may be attached to one side of the slot and the center conductor of the coaxial cable secured to the opposite side of the slot, the impedance being adjusted by moving the feed point along the length of the slot and adjusting the dimensions of the slot itself. Typically, a slot would be a half wavelength long. For example, a slot in the ground plane would be 18.75 inches long for reception of a signal at 315 megahertz.

Moreover, the directional sensitivity of the antenna is affected by the alignment of the antenna, and horizontal panels of the motor vehicles are not most advantageous for reception of higher frequency signals, for example on the order of a 315 megahertz signal used for remote keyless entry systems, or a 820–895 megahertz signal used for cellular phone systems. For example, U.S. Pat. No. 5,177,494 to Dorry et al. discloses a slot antenna arrangement in which a plurality of antennas are arranged in numerous orientations throughout the vehicle, thus substantially increasing the complexity and cost of the slot antenna system. Moreover, a ground plane aligned at a proper angle, for example a side panel or window area of the vehicle, would require a substantial surface area to be covered with a conductive material and thus tend to obscure visibility and interfere with operation of the vehicle.

Other known types of antennas have been adapted for use in the window area of motor vehicles. For example, it has been known to use the heater grid which extends across a large portion of the rear window as an AM radio signal antenna. However, such an antenna does not perform well in the FM radio frequency range and higher ranges. Accordingly, an additional antenna for reception of FM radio signals has been mounted to windows where the heated grid has been combined with developed filter circuits for reception of AM radio signals. For example, the FM antenna may be an extended conductor arranged in a zig-zag pattern across a substantial length of the rear window of the vehicle. As a result, there is very little window space left in a vehicle rear window carrying these known types of antennas for installation of additional antennas that could receive higher frequency radio signals, for example, radio signals used for remote keyless entry systems and cellular telephone systems, that would require large areas when constructed according to known techniques.

SUMMARY OF THE INVENTION

The present invention overcomes the above-mentioned disadvantages by providing a reduced ground plane slot antenna. Generally, the reduced ground plane antenna comprises a loop of narrow conductive strip, preferably in a rectiform form shape, having a length corresponding to a fraction of the predetermined wavelength to be received. More particularly, the length of the loop is a smaller fraction of wavelength than the half wavelength of an expanded ground plane slot antenna. As with previous slot antennas, the impedance of an antenna may be matched with the impedance of the transmission by adjusting the position of the terminals of the conductors, for example the center conductor and shield of a coaxial cable, on the conductive strip loop. Moreover, the reduced length of the antenna compared to previously known slot antennas, and the reduced dimension of the conductive strip provide substantially less obstruction to visibility than previously known antenna constructions. As a result, it is an advantage of the present invention that slot antennas of the type constructed according to the present invention can be used in conjunction with other window antennas such as heater grid and FM pattern antennas which may be mounted in a single window panel.

As a result, it will be understood that the present invention provides substantial advantages over previously known slot antennas. The present invention provides an advantageous glass mounted antenna for use with cellular telephone systems or remote keyless entry systems. Moreover, the conductive material ground plane occupies substantially less surface area than previously known slot antennas, so that the antenna does not obscure visibility over a large surface area. In addition, the present invention provides an advantageous antenna construction which provides improved gain by stacking a plurality of loops formed from conductive strips in accordance with the present invention. Furthermore, the present invention provides an advantageous window antenna structure including a multiple antenna construction in a single window panel.

BRIEF DESCRIPTION OF THE DRAWING

The present invention will be understood by reference to the following detailed description of the preferred embodiment, when read in conjunction with the accompanying drawing in which like reference characters refer to like parts throughout the views and in which:

FIG. 1 is a perspective view of a motor vehicle employing multiple antennas in a single window panel according to the present invention;

FIG. 2 is an enlarged plan view of one of the antenna structures shown in FIG. 1;

FIG. 3 is an enlarged plan view of another antenna construction shown in FIG. 1 according to the present invention;

DETAILED DESCRIPTION OF THE PREFERRED EMBODIMENT

Figure 4:
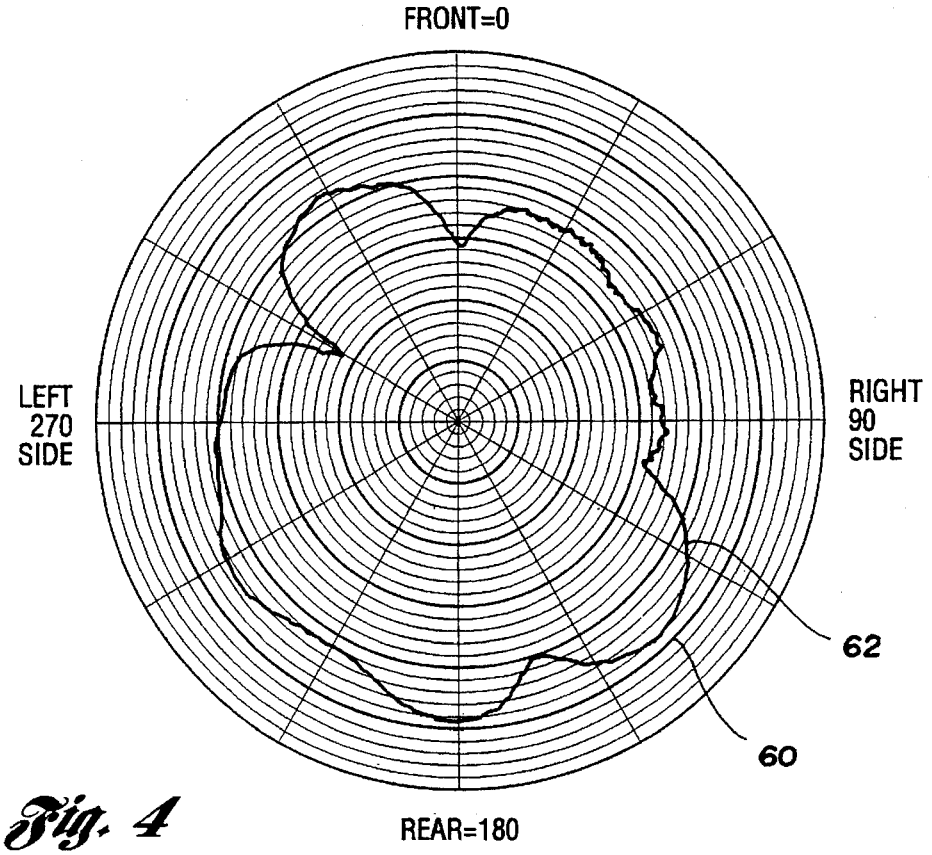
FIG. 4 is a graphical representation of the performance of an antenna shown in FIG. 2 receiving a vertically polarized radio signal.

Referring first to FIG. 1, a motor vehicle 10 is thereshown having a rear window 12. As in typical rear window constructions, the window panel is made of glass or glass/plastic laminate formed in a conventional manner to include conductive elements such as the rear defogger grid 14. For example, a known heater grid construction is made on the window panel by silk screen painting with a silver ceramic paint before heating the panel to about 1100° F. to 1200° F. and forming it to the desired shape before tempering. The silver ceramic paint includes about 95% silver with organic carrier, for example, pine oil, and about 5% glass frit. Heating of the painted panel drives off the organic material, sinters the silver and fuses the glass frit that melts at about 800° F. to 900° F. The grid may also be used as an antenna as will be described in greater detail.

Of course, other processes and constructions can be used to embed or otherwise mount an antenna, for example FM antenna 16, to a concealing panel such as window glass or other dielectric panel. Likewise, similar processes and constructions can be employed to form antennas designed and constructed according to the present invention, for example, as remote keyless entry antennas as shown at 18 for the remote keyless entry system 19 shown in FIG. 1, or as the antenna at 20 for the cellular telephone system 21 as shown in FIG. 1.

Although the invention is not limited to these particular embodiments, the combination of antennas shown in FIG. 1 provides an optimum location and advantageous packaging of antennas for a plurality of communication systems. The antennas of the present invention can fit within the perimeter of contemporary window openings along with other screen printed objects such as the heater grid, and provide a particularly useful combination of communication antennas for motor vehicles without obscuring visibility or occupying large conductive surfaces as with previous slot antennas.

As shown in FIG. 2, a model of the antenna 18 shown in FIG. 1 is embodied by a ground plane formed from a quarter inch wide strip 23 of copper foil tape with adhesive, for example, a 3M electrical tape about 0.002 inch thick cut and soldered at the corners to form the shapes shown in the drawing, rather than the wide surface area of conductive material previously employed to form the ground plane of a slot antenna. Nevertheless, other forms of conductors, such as the silver ceramic material used for defroster grid discussed above, can be used to form the ground plane of the antenna for the present invention. The illustrated embodiment aptly demonstrates the effectiveness of antennas constructed according to the present invention.

Antenna 18 with a substantially reduced ground plane was found to require a substantially shorter slot length 22, and thus a shorter overall length, of one third of the desired wavelength of 315 megahertz, or only about 13.062 inches (33.2 cm) long. In contrast, the length of a slot one half wavelength long at 315 megahertz is 18.75 inches (47.6 cm). As a result, the slot length is substantially less than a half wavelength which is ordinarily expected in a slot antenna. Moreover, the overall area occupied by the antenna is substantially smaller than previously known slot antennas. The width 24 of the slot is determined by conventional standards and practice from known texts, for example, a numerical length to width ratio. In the preferred embodiment, the spacing of 1.125 inches (2.8 cm) between the upper and lower strips matches the spacing existing between the defroster grid lines. Although such spacing is greater than needed for the desired bandwidth reception, it is well above the minimum of about ¼ inch (0.6 cm) required for reception within the RKE radio frequency range.

The impedance of the antenna is adjusted as with slot antennas by changing the location of the terminals 26 and 28. For example, the terminal 26 formed by center conductor of a coaxial cable 32 and the terminal 28 formed by the sheath of the coaxial cable 32 the opposite side of the slot, are positioned a distance 30, for example, 1.2 inches (3 cm), from the edge of the slot depending upon the impedance adjustment needed to match the input impedance of the signal transmission line. Moreover, the terminals 26 and 28 are moved together from the edge of the slot for mechanical convenience without adjusting the relative positions between the terminals 26 and 28.

As just described, the antenna 18 is readily adapted for reception of a predetermined range of frequencies with a sufficient gain to avoid the need for high gain amplification of the signal through an amplifier before reaching the remote keyless entry system 19. In particular, a system operating at a frequency on the order of 315 megahertz is compared with respect to the 0 db reference of a dipole antenna in FIGS. 4 and 5. The data illustrated was obtained by rotating an automobile on a turntable while subjecting the installed antenna panel to a radio signal source generating a polarized signal. At the coordinate position designated FRONT, the front of the car faces the signal source, while the RIGHT SIDE 90° coordinate position refers to a turntable position at which the right side of the vehicle faces the signal source. The 0 db level of a dipole antenna rotated on the turntable is shown at 60 while the curve 62 demonstrates performance of the antenna 18 installed in a rear light on a 1992 Mercury Sable in response to a vertically polarized source signal. Similarly, the curve 64 illustrates the 0 db level of a dipole antenna response, and the curve 66 illustrates the relative performance of the antenna 18 in response to a horizontally polarized source signal.

Figure 5:
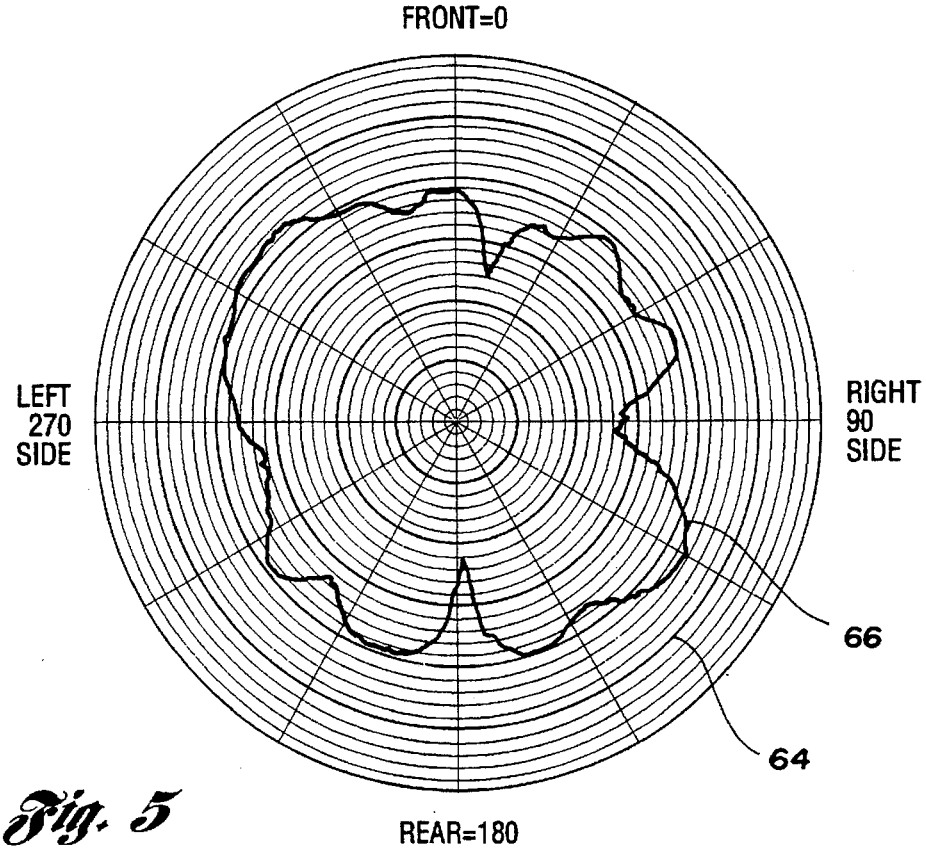
FIG. 5 is a graphical representation of the performance of an antenna shown in FIG. 2 receiving a horizontally polarized radio signal.

The test data was accumulated and plotted as shown in FIGS. 4 and 5. The figures represent an area mean of −7.9 db in FIG. 4 and an area mean of −11.9 db in FIG. 5, with a minimum-to-maximum ratio in FIG. 4 of 27.3 db and a minimum-to-maximum ratio of 21 db in FIG. 5. Nevertheless, an antenna according to the present invention may also be employed with remote amplifiers mounted close to the antenna or amplified receivers mounted elsewhere in the vehicle.

Additional performance for an antenna supported on a nonconductive panel such as a vehicle rear window has also been obtained by adding height to the slot. In addition, the improvement in gain provided by this adjustment is combined with an improvement in the antenna's bandwidth when a second element similar to the antenna 18 is added in parallel to form the antenna 20. As best shown in FIG. 3, the ground plane of antenna 20 is formed by a series of conductive loops. The ground plane comprises a conductive strip 43 forming an antenna for reception of radio signals on the order of 855 megahertz, and preferably in the range of 820–895 megahertz. The quarter inch (0.635 cm) copper tape conductor is aligned so that an upper slot having a width of 0.625 inches and a lower slot having a width of 0.875 inches is formed with a slot length of 5.00 inches. As with the antenna 18 described above, a cable conductor 52 includes a center conductor coupled to the upper tape strip at terminal 46 and the intermediate tape strip at a terminal 48, while a grounded shield of cable conductor 52 forms a terminal 50 on the lower strip of the conductive tape.

The terminals 46, 48 and 50 are located at a distance 1.0 inch (2.5 cm) from the end of the slot in this configuration to provide an impedance matching characteristic that permitted a gain 2 db greater than an antenna having only the lower one of the loops having a slot length of 5.00 inches. Of course as discussed above, different positions of the terminals may be used to affect the impedance represented by the antenna structure. The differing height of the antenna loops in a series of overlapping loops is determined to obtain additional gain and bandwidth improvements. Further improvements may be obtained by stacking additional elements dimensioned according to the performance desired. For example, the antenna 20 installed on the 1992 Mercury Sable had a lower loop width of 0.875 inches (2.2 cm) matching the heater grid spacing as discussed previously, but having a narrower upper loop with a width of 0.625 inches (1.6 cm) to raise the frequency of the bandwidth received by the antenna. The stacked arrangement of antenna 20 provides a 2 db improvement over an antenna including only the lower loop alone and with the accordance with the present invention.

Having thus described the present invention, many modifications thereto will become apparent to those skilled in the art to which it pertains without departing from the scope and spirit of the present invention as defined in the appended claims.

I claim:

1. A slot antenna having a slot in a reduced ground plane for a motor vehicle insulating panel comprising:

a conductive, narrow in relation to the width of the slot, strip formed in a loop on the insulating panel, said loop forming the slot having a length corresponding to a fraction of a predetermined wavelength, said reduced ground plane consisting of said strip formed in a loop peripherally defining the slot, wherein said fraction is smaller than the half wavelength of an expanded ground plane slot antenna, and wherein non-common conductor terminals are aligned across the slot on its length sides, and wherein said loop is rectiform.

2. The slot antenna as defined in claim 1 wherein said conductive strip comprises a conductive tape.

3. The slot antenna as defined in claim 1 wherein said strip is formed in a window glass.

4. The slot antenna as defined in claim 1 wherein said antenna is coupled to a receiver by a coaxial conductor having a central conductor secured on one side of said slot and a shield conductor secured on an opposite side of said slot.

5. The slot antenna as defined in claim 41 wherein said receiver is part of a remote keyless entry system.

6. The slot antenna as defined in claim 4 wherein said receiver is part of a cellular telephone.

7. An antenna for radio wave communication with a motor vehicle comprising:

a conductive loop formed on a window glass of the motor vehicle, said loop having a rectiform shape forming a slot with a length of less than a half wavelength of a predetermined signal frequency to be communicated, a reduced ground plane consisting of a peripheral, narrow in relation to the width of the slot, strip of conductor forming said loop, and non-common conductor terminals aligned across the slot on its length sides.

8. The slot antenna as defined in claim 7 wherein said predetermined signal frequency is a tuned frequency of a remote keyless entry system.

9. The slot antenna as defined in claim 7 wherein said predetermined signal frequency is a tuned frequency of a cellular telephone.

10. The slot antenna as defined in claim 7 wherein said antenna is coupled to a receiver by a coaxial conductor having a central conductor secured on one side of said slot and a shield conductor secured on an opposite side of said slot.

11. In combination with a motor vehicle window imprinted with a conductive grid for electric window defrosting, the improvement comprising an antenna imprinted upon the window and forming a slot antenna having a slot in a reduced area ground plane, said ground plane consisting of a flat and narrow, in relation to the width of the slot, strip conductor formed in at least two rectiform loops, each loop being the same length forming the slot having a length less than a half wavelength of a predetermined frequency to be received by the antenna, and non-common conductor terminals aligned across the slot on its length sides.

12. The slot antenna as defined in claim 11 wherein said predetermined frequency is a tuned frequency of a remote keyless entry system.

13. The slot antenna as defined in claim 11 wherein said predetermined frequency is a tuned frequency of a cellular telephone.

14. The slot antenna as defined in claim 11 wherein said antenna is coupled to a receiver by a coaxial conductor having a central conductor secured on one side of said slot and a shield conductor secured on an opposite side of said slot.

15. A slot antenna having a slot in a reduced ground plane for a motor vehicle insulating panel comprising:

a conductive, narrow in relation to the width of the slot, strip conductor formed in a closed loop on the insulating panel, said loop forming the slot having a length corresponding to a fraction of a predetermined wavelength, wherein said fraction is smaller than the half wavelength of an expanded ground plane slot antenna;

wherein said antenna comprises a stack of a plurality of closed loops having said length, each loop having non-common conductor terminals aligned across the slot on its length sides.

16. The slot antenna as defined in claim 15 wherein said loops overlap.

17. A slot antenna having a slot in a reduced ground plane for a motor vehicle insulating panel comprising:

a conductive, narrow in relation to the width of the slot, strip conductor formed in a loop on the insulating panel, said loop forming the slot having a length corresponding to a fraction of a predetermined wavelength, wherein said fraction is smaller than the half wavelength of an expanded ground plane slot antenna; and wherein said antenna comprises a stack of a plurality of loops having said length, each loop having non-common conductor terminals aligned across the slot on its length sides, and wherein said loops overlap.

* * * * *